United States Patent [19]

White

[11] Patent Number: 4,664,262

[45] Date of Patent: May 12, 1987

[54] PILL DISPENSING SYSTEM

[76] Inventor: Pamela J. White, 7087 Sierra Drive, Burnaby, British Columbia, Canada, V5A 1A4

[21] Appl. No.: 801,988

[22] Filed: Nov. 26, 1985

[51] Int. Cl.[4] ..... B65D 83/04; B65D 85/56

[52] U.S. Cl. ..... 206/531; 206/532; 206/534; 206/558

[58] Field of Search ..... 206/531, 532, 533, 534, 206/538, 828, 540, 558; 221/69

[56] References Cited

U.S. PATENT DOCUMENTS

| | | | |
|---|---|---|---|
| 564,103 | 7/1896 | Richardson | 206/533 |
| 3,279,651 | 10/1966 | Thompson | 206/533 |
| 3,393,795 | 7/1968 | Covert, Jr. | 206/533 |
| 3,494,322 | 2/1970 | Dubbels | 206/531 |
| 4,298,125 | 11/1981 | Berghahn et al. | 206/531 |
| 4,340,141 | 7/1982 | Fischer | 206/531 |
| 4,429,792 | 2/1984 | Machbitz | 206/531 |
| 4,449,630 | 5/1984 | Fillol | 206/533 |
| 4,473,156 | 9/1984 | Martin | 206/534 |

FOREIGN PATENT DOCUMENTS

| | | | |
|---|---|---|---|
| 795644 | 10/1968 | Canada | 206/540 |
| 571245 | 2/1933 | Fed. Rep. of Germany | 206/536 |
| 305087 | 5/1929 | United Kingdom | 206/540 |

*Primary Examiner*—William Price
*Assistant Examiner*—Brenda J. Ehrhardt
*Attorney, Agent, or Firm*—Townsend & Townsend

[57] ABSTRACT

A pill dispensing device having a carrier member. Open-sided compartments are formed in the carrier member, arranged in rows and columns. A breakable seal is located on the carrier member to close the open sides of each compartment to locate pills within the compartments. Time indicia are marked on the carrier member and aligned with the rows and columns of the compartments. A tray cooperates with the carrier member to locate the carrier member and the breakable seal. There is an outlet in the tray. Pills in the carrier member compartments may be forced through the seal of a compartment in a sequence indicated by the time indicia on the carrier member, into the tray amd removed from the tray through the outlet.

6 Claims, 6 Drawing Figures

Fig. 2.
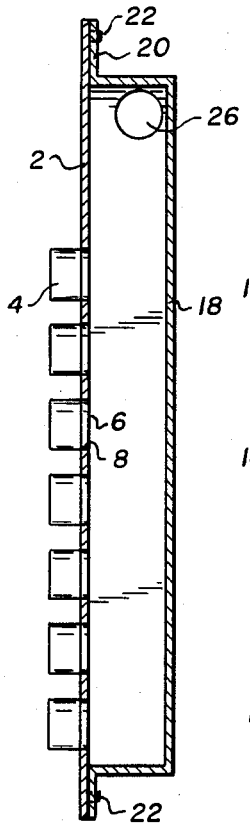
Fig. 1.
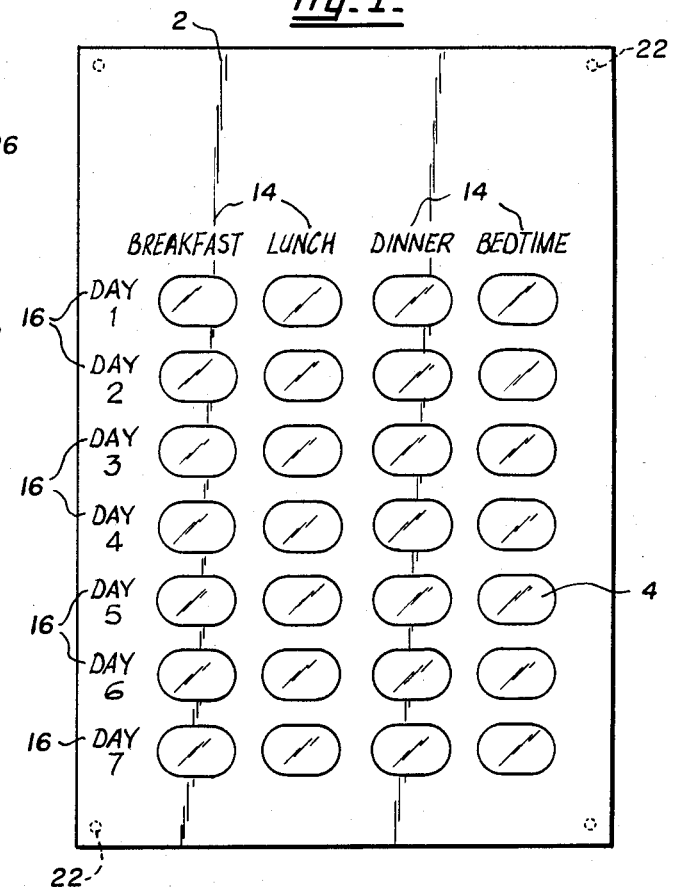
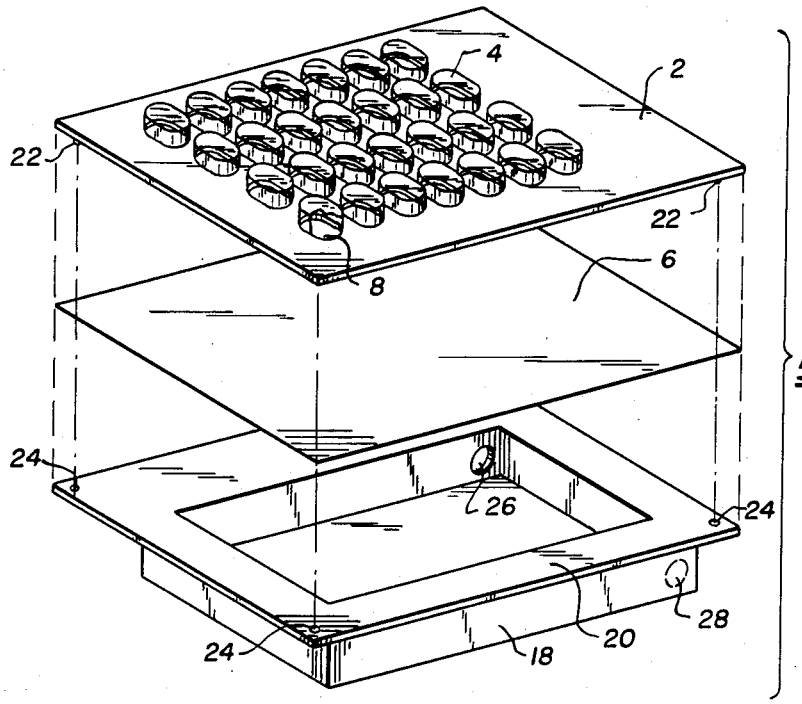
Fig. 3.

PILL DISPENSING SYSTEM

FIELD OF THE INVENTION

This invention relates to a pill dispensing device.

DESCRIPTION OF THE PRIOR ART

The dispensing of pills in non-medical establishments can be a considerable problem, particularly where the person taking the pills has been in hospital recently and is then required to take prescribed drugs in an unfamiliar routine or where the person taking the drugs is old or infirm. In many places the procedure has been to use visiting nurses to visit the patient at the appropriate time and ensure that the proper pills are taken at that time. If this is not carried out it has been observed that the necessary pills may not be taken at the appropriate time or, possibly worse, double doses are taken because the person is not sure whether he or she has taken the requisite dose at the appropriate time.

There have been a number of suggestions to avoid these problems. In the main these suggestions comprise the use of a device divided into compartments and attempts to mark the compartments with information as to when the pills should be taken. However, generally speaking the efforts have not been successful. It is still preferred to rely on visitors to ensure the proper dosage is taken at the proper time.

Examples of prior art patents indicating earlier attempts at tablet or pill dispensing containers and packages are U.S. Pat. Nos. 4,074,806 to Ardito; 4,158,411 to Hall; 3,912,081 to Haines; 3,494,322 to Dubbels; 3,351,191 to La Plante; 4,473,156 to Martin; 4,318,477 to Kerpe; 4,039,080 to Cappuccilli; 4,038,937 to Moe; 3,618,559 to Moe; 4,148,273 to Hollingsworth.

SUMMARY OF THE INVENTION

The present invention seeks to provide a simple method of ensuring that the proper dose is taken at the proper time and to avoid the risk of repeating that dose at an inappropriate time. The system permits the administration of all the drugs necessary for a patient at one time. In certain cases this may comprise a number of pills. This can be a disadvantage in handling the number of pills but the present invention also provides a simple way of ensuring that the pills are not lost by the user.

Accordingly, in a first aspect, the present invention is a pill dispensing device comprising a carrier member; a plurality of open-sided compartments in the carrier member, arranged in rows and columns; a breakable seal located on the carrier member to close the open sides of each compartment to locate pills within the compartments; time indicia marked on the carrier member and aligned with the rows and columns of the compartments; a tray adapted to cooperate with the carrier member to locate the carrier member and the breakable seal; an outlet in the tray; pills in the carrier member compartments may be forced through the seal of a compartment in a sequence indicated by the time indicia on the carrier member, into the tray and removed from the tray through the outlet.

In a further aspect the invention is a pill dispensing device comprising a first support member; a plurality of first openings in the first support member, arranged in a pattern of rows and columns; a second support member hingedly attached to the first support member; a plurality of second openings in the second support member arranged in the same pattern of rows and columns as in the first support member and thus aligned with said first openings; a carrier member; a plurality of open-sided compartments in the carrier member, arranged in rows and columns that can align with the rows and columns defined by the first and second openings; a breakable seal located on the carrier member to close the open sides of each compartment to locate pills within the compartment; whereby the carrier member can be clamped between the first and second members with the compartments projecting through the second openings and the open sides of each compartment aligned with the first openings so that pressure applied to a compartment will force the contents of the compartment through the seal of the compartment.

DRAWINGS

Aspects of the invention are illustrated, merely by way of example in the accompanying drawings in which:

FIG. 1 is a plan view of a device according to the present invention;

FIG. 2 is a side elevation of FIG. 1;

FIG. 3 is an exploded view of the device according to the present invention;

DESCRIPTION OF THE PREFERRED EMBODIMENTS

Figure 4:
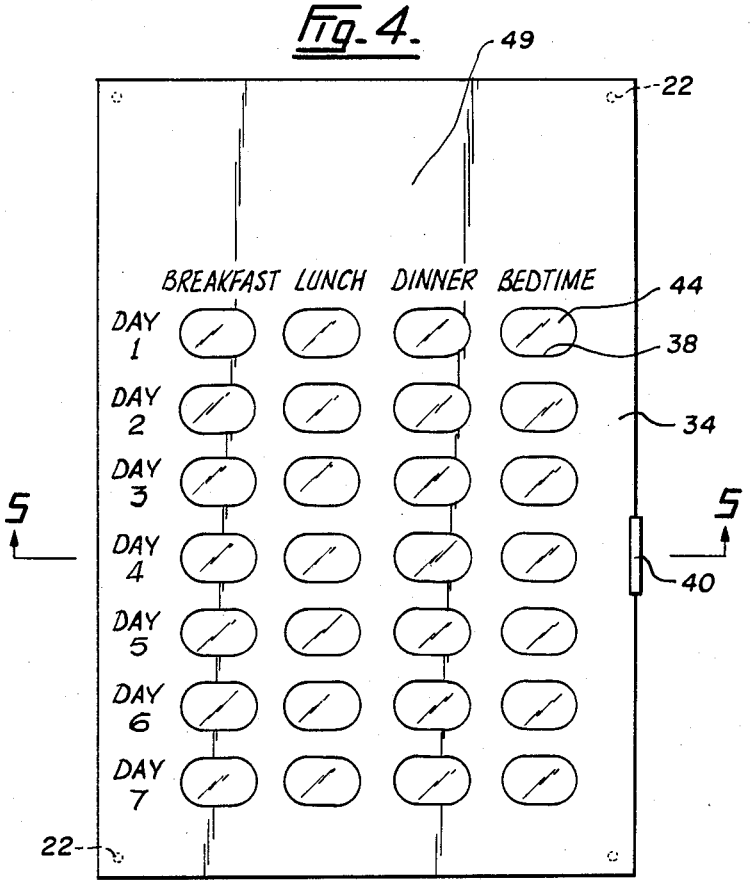
FIG. 4 is a plan view of the second embodiment.

The drawings show a pill dispensing device comprising a carrier member 2 formed, for example by blow molding, with a plurality of open sided compartments 4 arranged in rows and columns. As shown particularly in FIGS. 1 and 3 there is a breakable seal 6 located on the carrier member 2 to close the open sides 8 (the bases in the embodiment as shown in the drawings) of the compartments 4. There are time indicia 14 and 16 marked on the carrier member 2 and aligned with the rows and columns of compartments 4. Again the arrangement is most clearly shown in FIG. 1. As shown in that drawing the member 2 has a list of days, day 1 through day 7, arranged in a vertical column and a list of times for each day arranged in a horizontal row. The information provided can, of course, vary with each patient.

The device includes a tray 18 that is adapted to receive the carrier member 2 and the breakable seal 6. The tray is provided with a peripheral flange 20 that contacts the carrier member 2. As shown particularly in FIGS. 2 and 3 the carrier member 2 is desirably formed with integral studs 22 that are a press-fit in openings 24 formed at the corners of the peripheral flange 20 of the tray 18. By this means the carrier member 2 may be secured firmly to the tray 18 but, on the application of appropriate force can be removed from the tray.

There is an outlet 26 in the tray. The outlet 26 simply comprises an opening that may be molded into the tray. The tray 18 may be provided with a push-out 28 at the opposed corner, in the manner of an electrical box, and the eventual user of the device can simply decide which outlet is to be used by pushing out the appropriate push-out. For example a left-handed person may prefer an outlet in a position different from a right-handed person.

To use the device according to FIGS. 1 to 3 first the compartments 4 are filled in a pharmacy with the appropriate medication, according to a prescription by a doctor. It should be noted that each compartment can contain all the medication that should be taken by a patient at one time. For example a patient may need to take four pills at breakfast-time at day 1 and all those four pills can be placed in the one compartment 4. If the dose is varied at lunch-time then that is easily attended to by simply placing the appropriate pills in the compartment located by the indicia lunch and day 1. The compartments are closed by seal 6 and the carrier 2 attached to tray 18 by studs 22 engaging holes 24.

When the patient is to take the prescribed medicine pressure is applied to the upper surface of a compartment 4 forcing the pills in the compartment to break the seal 6 and move into the tray 18. The tray is then tipped at the appropriate angle so that all the pills may be gathered in the hand of the patient who then takes the pills.

It will be immediately apparent that anyone looking at the device can tell exactly which doses have been taken and there is no risk of repeating a dose too soon. Furthermore because of the use of the tray 18, with its outlet 26, the risk of a pill being forced from the compartment and then being lost on the floor is removed.

The device of the present invention may have the tray 18 made of a clear, structurally strong plastic material. The seal 6 to close the compartments 4 may be a metal foil, coated with an adhesive, and the carrier member 2, and the open-sided compartments 4 formed in it, may be formed by blow molding or vacuum molding of a plastic sheet. The clips 22 may be nylon or PVC. As indicated above such clips are well-known.

Figure 5:
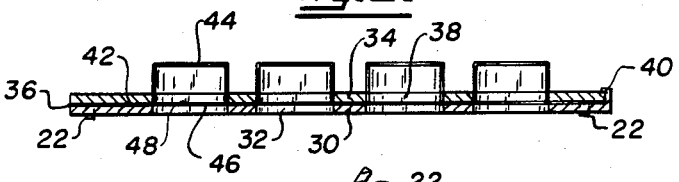
FIG. 5 is a view on the line 5—5 in FIG. 4.
Figure 6:
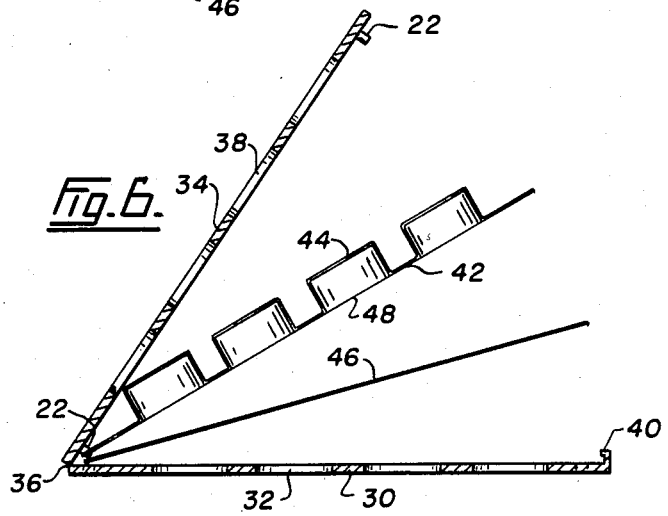
FIG. 6 shows hinging of the second embodiment.

In the embodiment of FIGS. 4 to 6 the pill dispensing device comprises a first support member 30 with a plurality of first openings 32 in the first support member 30. Again, as in the embodiment of FIG. 1, the openings 32 are arranged in a pattern of rows and columns. There is a second support member 34 hingedly attached at 36 to the first support member 30. The hinged joint may, for example, be a simple plastic hinge. The durability of such hinges is well known.

There is a plurality of second openings 38 in the second support member 34 arranged in the same pattern of rows and columns as in the first support member 30 and, because of the hinged attachment of the first and second support members, thus aligned with the first openings. Catch member 40 holds the members 30 and 34 together. As in the embodiment of FIGS. 1 to 3, there is a carrier member 42 with a plurality of open-sided compartments 44 integrally formed in the carrier member 42 and, again, arranged in rows and columns. A breakable seal 46, again as in FIG. 1, is located on the carrier member 42 to close the open sides 48 of each compartment to locate pills within the compartment.

The tray is not shown in the embodiment of FIGS. 4 to 6 and is not necessary. However the second support member can be provided with studs 22 as shown in the FIGS. 1 to 3 embodiment and the device attached to a tray as shown in FIG. 3.

In use the compartments 44 are filled in a pharmacy with the prescribed medicine. Again each compartment can contain all the medication for one time—as in the embodiment of FIGS. 1 to 3. The seal 46 is placed over the carrier member 42. The carrier member 42 is then fitted into the second support member 34 with the compartments 44 projecting through the openings 38. The second support member 34 is moved downwardly to engage catch member 40 of the first support member. The device is then ready to be used as in the FIGS. 1 to 3 embodiment.

The blank area 46 shown in FIG. 4 may be used to print prescription information concerning the pills.

Thus the present invention provides a simple solution to the problem of incorrect dosages and also a solution to the problem that the dose, once moved from a compartment, may be lost on the floor.

I claim:

1. A pill dispensing device comprising a carrier member;

a plurality of open-sided compartments in the carrier member, arranged in rows and columns;

a breakable seal located on the carrier member to close the open sides of each compartment to locate pills within the compartments;

time indicia marked on the carrier member and aligned with the rows and columns of the compartments, the time indicia comprising a list of days in a column and a list of time for each day in a row;

a tray adapted to cooperate with the carrier member to locate the carrier member and the breakable seal;

an outlet in the tray; whereby pills in the carrier member compartments may be forced through the seal of a compartment in a sequence indicated by the time indicia on the carrier member, into the tray and removed from the tray through the outlet.

2. A device as claimed in claim 1 in which the carrier member and the open sided compartments are formed integrally of a transparent, flexible material.

3. A device as claimed in claim 1 in which the breakable seal is a foil adhered to the carrier member to close the compartments.

4. A device as claimed in claim 1 in which the tray is formed with a peripheral flange to provide a clamping surface for the carrier member.

5. A device as claimed in claim 1 in which the tray has a plurality of potential outlets formed by the use of pushout sections, the desired outlet being selected by the eventual user.

6. A device as claimed in claim 1 in which each compartment contains all the pills to be taken at one time as defined by the time indicia.

* * * * *